US006249587B1

(12) United States Patent
Clavadetscher et al.

(10) Patent No.: US 6,249,587 B1
(45) Date of Patent: Jun. 19, 2001

(54) HEARING AID TO BE WORN COMPLETELY IN THE AUDITORY CANAL AND INDIVIDUALIZED BY A CAST BODY

(75) Inventors: Jürg Clavadetscher, Ortschwaben; Marcel Aeschlimann, Biel, both of (CH)

(73) Assignee: Bernafon AG, Bern (CH)

( * ) Notice: Subject to any disclaimer, the term of this patent is extended or adjusted under 35 U.S.C. 154(b) by 0 days.

(21) Appl. No.: 08/899,415

(22) Filed: Jul. 23, 1997

(30) Foreign Application Priority Data

Jul. 24, 1996 (CH) ..... 1859/96

(51) Int. Cl.[7] ..... H04R 25/00
(52) U.S. Cl. ..... 381/322; 381/324
(58) Field of Search ..... 381/322, 324, 381/325, 328; 264/134, 135, 161, 222

(56) References Cited

U.S. PATENT DOCUMENTS 4,834,927 * 5/1989 Birkholz et al. ..... 264/134
4,870,688 * 9/1989 Voroba et al. ..... 381/322
5,530,763 * 6/1996 Aebi et al. ..... 381/322

* cited by examiner

*Primary Examiner*—Curtis A. Kuntz
*Assistant Examiner*—Rexford N. Barnie

(57) ABSTRACT

A hearing aid is worn completely in the auditory canal to the individual form of which it is precisely adapted and it has element a body consisting of a soft material (Shore hardness A from 5 to 70). This body is the supporting element of the appliance and the components (10, 11, 12) serving the hearing function are cast into the body substantially floating. In its general condition, i.e. in a condition not yet adapted to an individual auditory canal, the hearing aid comprises an element which limits its axial length, this length-limiting element is e.g. a bar-shaped, provisional supporting element (18) protruding from the hearing aid on the inner and on the outer face and being fixed by a locking arrangement (25). After casting the body by filling the casting cavity (31) with a casting material when the general hearing aid is placed in an auditory canal or in a model of an auditory canal, the provisional supporting element (18) is removed leaving a ventilation channel (43) through the cast body.

37 Claims, 5 Drawing Sheets

HEARING AID TO BE WORN COMPLETELY IN THE AUDITORY CANAL AND INDIVIDUALIZED BY A CAST BODY

The invention is in the field of hearing aids and concerns a hearing aid to be worn completely in the auditory canal according to the generic part of the independent claim. The inventive hearing aid is adaptable to an individual auditory canal by casting its body in an auditory canal or in a model of it which casting brings the hearing aid from a general condition into an individualized condition.

Hearing aids to be worn in the auditory canal, so called CIC-appliances (CIC for "Completely In the Canal") like other hearing aids, substantially comprise the following components serving the hearing function: a microphone directed towards the outside of the auditory canal for reception of sound from the outside world and the transformation of this sound into electric signals, an amplifier for amplification of these electric signals, a loudspeaker facing the inside of the auditory canal for transformation of the amplified electric signals into sound and a power source (battery) for operation of the named components. The amplifier is normally designed as an integrated circuit (chip) and may, in addition to its amplifying functions have control functions and/or be programnmable. The hearing aid can additionally comprise a receiving coil for data reception for remote control of the appliance or for reception of radio or telephone signals. The hearing aid can also be designed for the reception of radio signals only and then comprise a receiving coil only and no microphone.

Furthermore a CIC-hearing aid must have supporting elements like any other hearing aid and is advantageously adapted in its form to the auditory canal of the individual wearer as precisely as possible.

The CIC-hearing aid has acoustic and aesthetic advantages compared to other bearing aids which can reach into the auditory canal but which are not worn completely in the auditory canal. The acoustic advantages of the CIC-hearing aid are mainly that the space between the eardrum and the inner end of the appliance is smaller which increases the quality of sound and reduces the necessary amplification, i.e. the energy needed for operation. The aesthetic advantages of the CIC-appliances are that the appliance is less visible.

New problems to be solved regarding CIC-appliances mainly arise from their reduced size compared to other appliances and from the fact that they are positioned deeper in the auditory canal than other appliances. A typical CIC-hearing aid has the form of an irregular cylinder with a middle diameter of ca. 6 mm and an axial length of ca. 20 mm, whereby the diameter is determined by the inner diameter of the auditory canal and the length is determined substantially by the components serving the hearing function. The outer face of the appliance is formed by a face plate with a battery opening. The outlet of the loudspeaker is arranged on the inner face which loudspeaker is positioned at a distance of ca. 3 mm from the eardrum when the appliance is worn.

According to the state of the art, structures and production methods for ITC-appliances (ITC for "In The Canal") are used as structures and production methods of CIC-appliances also. The ITC-appliance is designed such that its inner end carrying the loudspeaker reaches into the auditory canal but a larger part is positioned in the region of the extended outlet of the auditory canal, i.e. in the external ear. This kind of ITC-appliance mostly comprises a shell as a supporting element, which shell has a cavity in which the components for the hearing function are arranged. The shell is normally produced from a hardening casting material in a mould made from a cast of an auditory canal. It is also suggested to cast this kind of shell directly in the auditory canal.

Other ITC-appliances have a skeleton to which the components serving the hearing function are fixed. The skeleton carrying the components is surrounded with a hardening material by casting, advantageously directly in the auditory canal, whereby a body having a form adapted to the individual auditory canal is formed. As this body does not have a supporting function it can be produced from a soft material which makes the hearing aid more comfortable to wear. This kind of appliance and corresponding production methods are e.g. described in publications EP-629101 and WO-92/03894.

The main difference between the CIC-appliances and ITC-appliances is, as previously mentioned, the substantially reduced size of the CIC-appliance and its position in the auditory canal which is substantially deeper. The size of the components serving the hearing function is substantially the same as with other hearing aids. The position if the CIC-appliance in the auditory canal is such that the appliance reaches from an outer part of the auditory canal, which is cartilaginous and the form of which is subject to relatively important changes when the jaws are moved, to an inner part of the auditory canal which inner part is bony, has a form which hardly changes and is extremely sensitive to touch. In particular, the CIC-appliance has no support from a part positioned in the cartilaginous elastic and relatively form-constant outlet of the auditory canal.

The named differences between the small CIC-appliances and the larger ITC-appliances lead to difficulties in the production of CIC-appliances which cannot be optimally solved by the structures and production methods taken over directly from the ITC-appliances. In order for the CIC-appliance to be able to be worn comfortably in the auditory canal even when the form of the canal changes in certain regions due to movement of the jaws and in order not to be worked out of the auditory canal by this jaw movement, the hearing aid must be adapted precisely to the form of the auditory canal and it must be sufficiently soft such that it can at least partly adapt to the changes of the form of the auditory canal. The part of the appliance positioned in the bony part of the auditory canal must fulfil similar requirements due to the high sensitivity of this part of the auditory canal.

If a shell is to be the main supporting element of a CIC-appliance it has to have a sufficient functional strength. On the other hand it should be soft for the reasons mentioned above. From this results that it requires a wall thickness which is impossible because of the small diameter of the CIC-appliance. Therefore, the softness of the shell and with it the wearing comfort has to be subordinated under the necessary strength and the necessary small size and cannot be optimal.

A skeleton for taking over the main supporting function and surrounded by a cast soft material serving the wearing comfort only and not having any mechanical functions, requires space on the inside of the appliance which space is very scarce in a CIC-appliance even for accommodation of the components serving the hearing function.

The object of the invention is to create a hearing aid which allows the miniaturization required by a CIC-appliance and which all the same offers maximal comfort to the wearer, i.e is in particular soft enough to adapt itself to the deformations of the auditory canal resulting from movement of the jaws such that these deformations do not lead to a reduction of comfort. Furthermore, the inventive hearing aid is to be able to be brought from a general condition into an individualized condition such that it is suited for an individualization directly in the ear of the wearer, an individualization which can be carried out by an auditory advisor. In particular, the appliance in its general condition is to comprise as far as possible all the components of the appliance except of the individually formed body and is not to require any further processing after the individualizing step.

This object is achieved by the CIC-hearing aid as defined in the claims which hearing aid for individualization is brought from a general condition, i.e. a condition in which it is not yet adapted to an individual auditory canal, to an individualized condition, i.e. a condition in which it is adapted to an individual auditory canal.

The inventive hearing aid differs from known hearing aids (CIC or ITC) especially in that it neither comprises a shell surrounding a cavity for other components nor a skeleton serving as supporting element and being surrounded by a cast body. The supporting function of the inventive hearing aid is taken over solely by its body which is adapted to the individual auditory canal and into which the components serving the hearing function are cast in a quasi swimming condition. This body with the cast-in components has a cross-section over the whole axial length of the appliance which is sufficient to provide the necessary functional strength for the mechanical supporting function even when consisting of a rather soft material (Shore hardness A from 5 to 70).

It shows that the hearing aid in its general condition in which it does not have a body yet and in which it has to be introduced into the auditory canal only once, namely for the individualization step, can be without a supporting element. It shows that even without a stiffening element between its two faces, the appliance can be positioned in the auditory canal with the necessary diligence. However, it shows also that it is necessary to limit its axial length. An element limiting the axial length of the general appliance is to guarantee that the casting pressure does not lengthen the hearing aid such that its innermost part comes too close to the hearing drum or even touches it, which is very hurtful. It shows also that the general hearing aid on introducing it into the auditory canal may be shortened in axial direction and will extend to the length given by the length-limiting element on casting the body.

Therefore, the inventive hearing aid comprises in its general condition an element limiting its axial length by constituting an upper length limit. This length-limiting element may be a stiff element serving at the same time as a provisional supporting element which after the body is cast is removed from the appliance. However, the length-limiting element can also be a flexible lengthwise not extendible string which is either removed or not after the body is cast. A length-limiting element which is to be removed from the appliance protrudes over at least one of the faces of the appliance. If the element is stiff it is advantageously plastically deformable (e.g. metal wire). The length-limiting element, if protruding over both faces of the appliance, may serve also as the mould for a ventilation channel through the appliance from its one face to its other face.

The inventive hearing aid in its general condition comprises at least a microphone or receiving coil, an amplifier-chip and a loudspeaker as components serving the hearing function and a face plate forming the face in which face plate a battery opening and an opening for a ventilation channel or the length-limiting element respectively are provided. The inner face of the hearing aid is formed substantially by the outlet side of the loudspeaker. A substantially tubular, extensible membrane extends between the face plate and the inner face and is joined tightly around the face plate and the loudspeaker with suitable connecting means. The membrane forms a casting cavity which is filled with a casting material through the battery opening in the face plate. The inner connecting means (tight joint between loudspeaker and membrane) is e.g. designed as an elastic gasket substantially having the form of an eight with one opening for the loudspeaker and a second opening for a ventilation channel or the length-limiting element respectively. A length-limiting element to be removed after casting extends substantially axially through the casting cavity and through the corresponding openings in the face plate and in the connecting means to the outside where corresponding locking means are provided for preventing the length of the element within the appliance to extend beyond a predetermined value.

The individualized hearing aid is produced from the general hearing aid substantially by pouring a casting material which advantageously hardens to form a body with a Shore hardness A of 5 to 70 through the battery opening in the face plate into the casting cavity. When the body has hardened the length-limiting element may be removed, whereby a ventilation channel extending axially through the body is opened.

The simple production of the body and the extremely simple steps for completing the appliance which are necessary after casting (no processing of the cast body) make the inventive hearing aid extremely suitable for an individualization carried out directly in the auditory canal, i.e. an individualization which can be carried out directly by an auditory advisor such that a potential wearer can practically have a hearing aid after only one session with the auditory advisor. Naturally, it is possible also to bring the inventive hearing aid into an individualized condition with the help of a model of an auditory canal produced via a cast taken from an individual auditory canal.

Exemplified embodiments of the inventive CIC-appliance in a general and in an individualized condition are to be described more in detail in connection with the following Figures, whereby FIGS. 1 and 2 show an exemplified embodiment of the inventive CIC-hearing aid in a general and in an individualized condition, both as diagrammatic sections parallel to the axis;

FIGS. 3 and 4 two further embodiments of the inventive hearing aid in the general condition;

Figure 2:
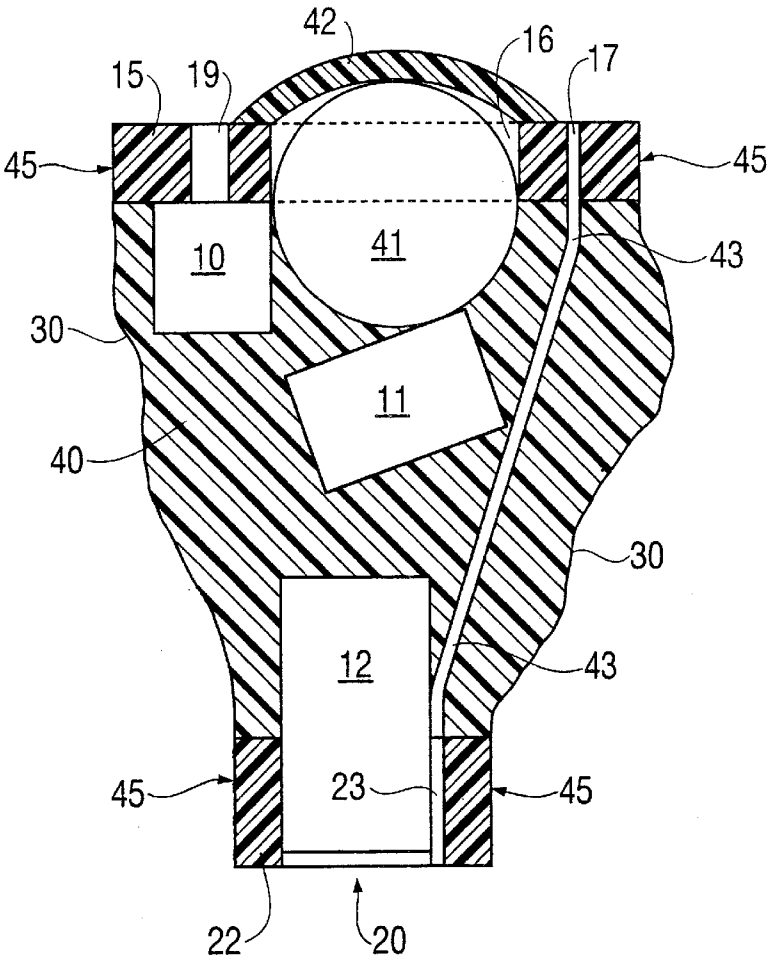
Figure 1:
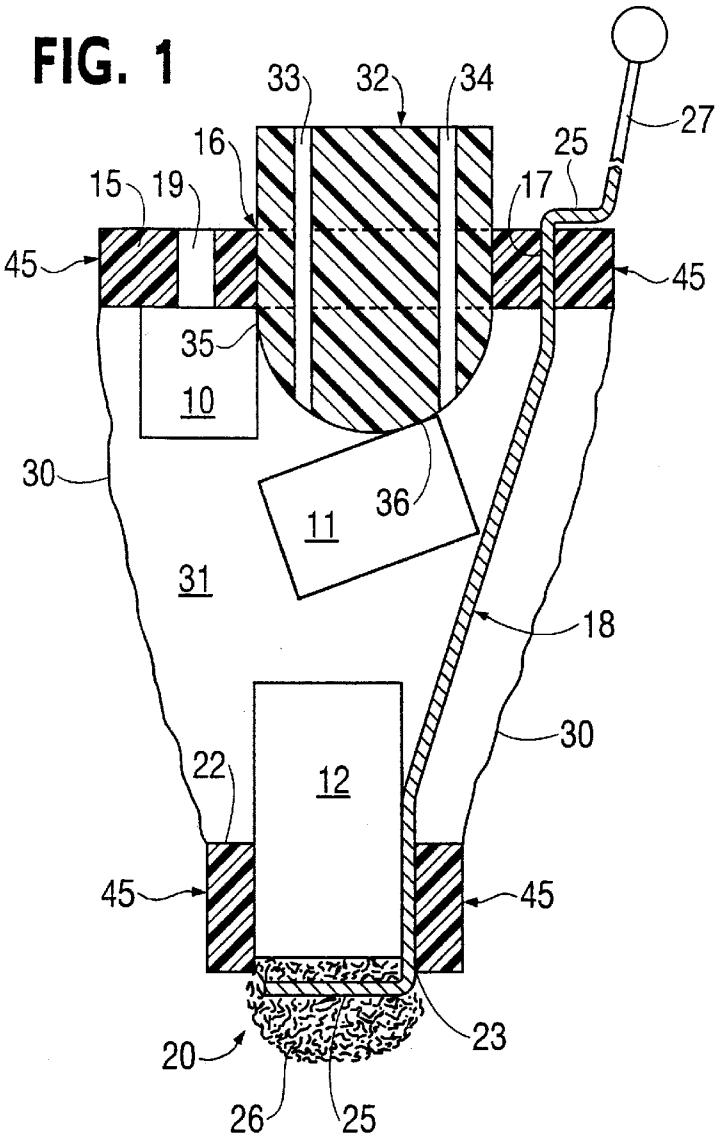

FIGS. 1 and 2 show as diagrammatic sections, an exemplified embodiment of the inventive hearing aid in its general condition (FIG. 1) and in its individualized condition (FIG. 2). As previously mentioned the hearing aid in its general condition and in its individualized condition comprises e.g. a microphone 10, an amplifier-chip 11 and a loudspeaker 12 as components serving the hearing function. These components and a battery yet to be positioned are functionally connected with electrical lines which are not shown. Furthermore the appliance comprises a face plate 15 with a battery opening 16, an opening 17 for a provisional supporting element 18 and an opening 19 for the microphone 10, whereby instead of the microphone opening 19 a perforated sieve-like area can be provided. The inner face 20 of the appliance is mainly formed by the outlet-side of the loudspeaker 12 and by connecting means 22.

FIG. 1 which shows the hearing aid in its general condition shows the provisional supporting element 18 which e.g. consists of an easily bendable metal wire or metal tape and which runs through opening 17 of face plate 15 in substantially axial direction towards the inner face 20 and through an opening 23 in connecting means 22. On the outside of face plate 15 locking means 25 are provided which impede a shifting of supporting element 18 into opening 17. These locking means 25 can e.g. be, as shown, a curve or a thicker part. The function of the locking means can also be taken over by a corresponding dimensioning and material pairing of openings 17 and 23 on the one hand and the provisional supporting element 18 on the other hand such that the static friction of the supporting element 18 in openings 17 and 23 is sufficient to lock these in a defined relative position. In this case it is not necessary for the provisional supporting element to protrude through both faces of the hearing aid.

The provisional supporting element 18 can further comprise a part 27 protruding over face plate 15 with the help of which the appliance is introduceable into the auditory canal for individualization. On the inner face 20 of the appliance the supporting element 18 is equipped with locking means 25 which e.g. consist, as shown, of a further curve and a tampon 26 fixed to this curve. Tampon 26 is a security element which is known from the manufacturing of moulds of auditory canals and with which the general hearing aid is prevented from being pushed too near to the eardrum for the individualization process. The tampon 26 e.g. consists of a foamed material or of cotton wool.

Between face plate 15 and connecting means 22 surrounding the loudspeaker in the region of the inner face, a substantially tubular extensible membrane is provided and is fixed around the face plate 15 and around the connecting means 22 such that it forms a casting cavity 31 which can be filled with a casting material through the battery opening 16 in the face plate 15.

In order to form a battery rack between the face plate 15 and the body to be cast, a casting template 32 is positioned in the battery opening 16 of the face plate 15. The part of the casting template 32 projecting into the casting cavity 31 has substantially the form of the battery rack to be formed.

Furthermore, the casting template 32 comprises a pouring opening 33 and a ventilation opening 34. When casting the body the casting material is injected through pouring opening 33 and displaced air escapes through the ventilation opening 34.

Figure 7:
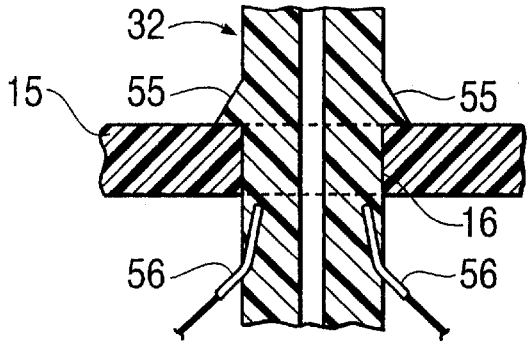
FIG. 7 shows a diagrammatic section parallel to the axis of the hearing aid through a casting template positioned in the battery opening of the face plate whereby the section plane is perpendicular to the section planes of FIGS. 1 and 2.
Figure 8:
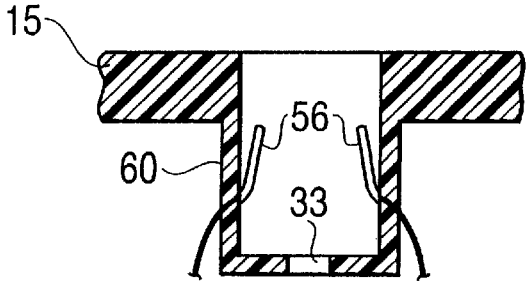
FIG. 8 shows a diagrammatic section similar to FIG. 5 through a further embodiment of a face plate for an inventive hearing aid.

Besides being the means for forming a battery rack, the casting template also serves for positioning not only at least part of the hearing aid components serving the hearing function but also for positioning battery contacts such that they have a defined position in the cast body (see also description in connection with FIGS. 7 and 8). For this purpose e.g. holding elements (not shown in FIG. 1) for microphone 10 and amplifier-chip 11 are provided in locations 35 and 36 which elements stay in the body or are removed when the casting template 32 is removed from the cast body.

It is evident from FIG. 1 that the provisional supporting element 18 and the connecting means 22 keep the loudspeaker 12 in a defined position relative to the face plate 15, whereby this position is restrictedly variable according to the flexibility of the supporting element 18. Thanks to such plastic flexibility, the hearing-aid is roughly adaptable to the individual auditory canal already in its general condition. It is also evident that the axial length of the hearing aid is only given an upper limit by the provisional supporting element 18 and by the locking means 25, i.e. the appliance can not be lengthened beyond a predetermined limit but it can be compressed, i.e. the face plate 15 is e.g. movable towards the loudspeaker. This kind of movement however is as mentioned already restricted by the further components of the appliance and it is reversed by the casting pressure created when the body is cast.

FIG. 2 shows the same embodiment of the inventive hearing aid as FIG. 1 but in its individualized condition, again in section parallel to the axis. In this condition it differs from the general condition in that there is a cast body 40 in casting cavity 31 (FIG. 1) within the membrane 30. For casting, a natural auditory canal or a model of such a canal is used as actual casting mould the extensible membrane being pressed against the inner wall of this mould such that the body 40 receives a form precisely adapted to the auditory canal. Casting template 32 (FIG. 1) is removed from the battery opening 16 in the face plate 15 and a battery 41 is inserted into the battery rack formed by the casting template. The battery opening 16 in the face plate 15 is closed with a battery cover 42.

Furthermore, the appliance in its individualized condition differs from the general condition in that the provisional supporting element 18 is removed and instead of it a ventilation channel 43 leads through the appliance or through face plate 15 (opening 17), body 40 and connecting means 22 (opening 23) respectively. The provisional supporting element 18 is removed by removing the locking means 25 (e.g. straighten the curve) on the inner or on the outer face and by pulling the supporting element out of the appliance from the opposite side. If the supporting element is sufficiently bendable it can also be pulled out of a curved ventilation channel without problems.

The membrane 30 of the inventive hearing aid consists e.g. of a thermoplastic elastomer, e.g. based on a siliconplastic and it has a thickness of ca. 0.2 mm. Further examples of materials suitable for the membrane are: oriented poly-tetrafluorethylene (Goretex®) or extrudable two-component silicon plastics.

The most important condition which the membrane material must fulfil are a sufficient extendibility, a mechanical stability sufficient for a safe handling of the appliance in its general condition and a sufficient inoffensiveness in contact with skin. Furthermore, the membrane is advantageously porous, i.e. permeable to air and impermeable to the casting material such rendering a ventilation opening unnecessary.

The membrane 30 advantageously reaches over at least part of the cicumferential area of the face plate 15 and of the connecting means 22 of the inner face and is fixed tightly around the face plate and the connecting means (locations 45), e.g. by means of welding, gluing or corresponding positive engaging means. The Swiss application No. 1861/96 (parallel application to the present application) is concerned in detail with membranes for hearing aids to be individualized by casting of a body and with means for the tight fixing of such membranes to a face plate and/or around a loudspeaker and a provisional supporting element.

The body 40 of the hearing aid is produced e.g. from a two-component addition-cross-linked silicon material. In fact every casting material is suitable for producing the body as long as it hardens at room temperature advantageously without developing gas and turning into a body with a Shore hardness of advantageously 5 to 70.

When using a membrane based on silicon and a casting material also based on silicon it shows that due to the chemical relationship of the two materials a mutual connection is formed between membrane and body such that the membrane cannot be peeled from the body. If a Goretex®-membrane is used a similar strong connection is formed between the surface of the body and the membrane which is probably caused by at least partial penetration of the casting material into the pores of the membrane by which anchorage points are created.

It further shows that in most cases the adhesion between a substantially planar face plate 15 and the body 40 is a sufficient mechanical connection between the face plate and the body after removal of the provisional supporting element. If however, this adhesion is not sufficient, means for enlarging the surface (grooves or other irregularities) or even positive engaging means can be provided on the inner surface of the face plate due to which positive engaging means the connection between body 40 and face plate 15 is strengthened.

Figure 4:
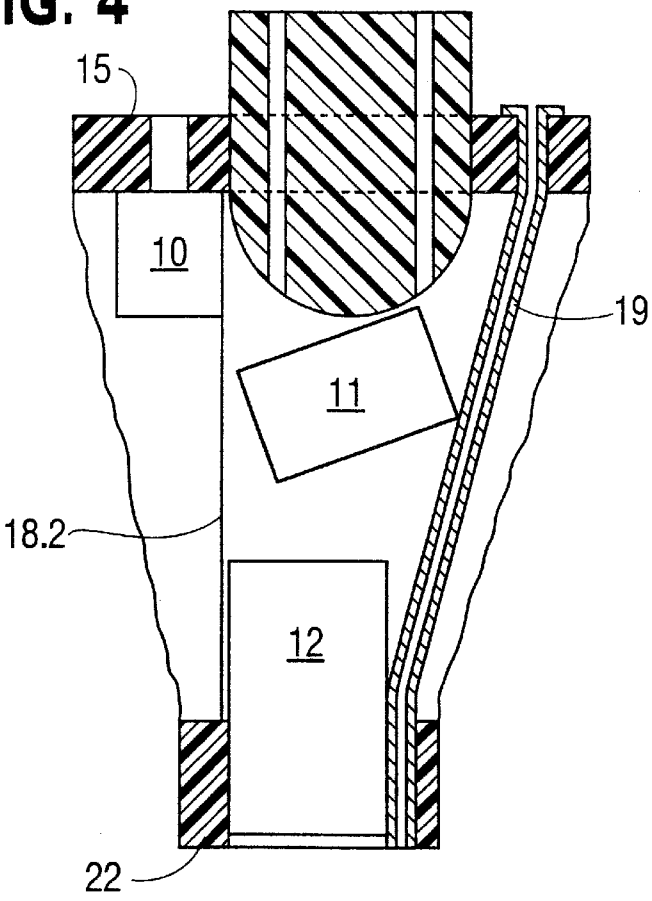
Figure 3:
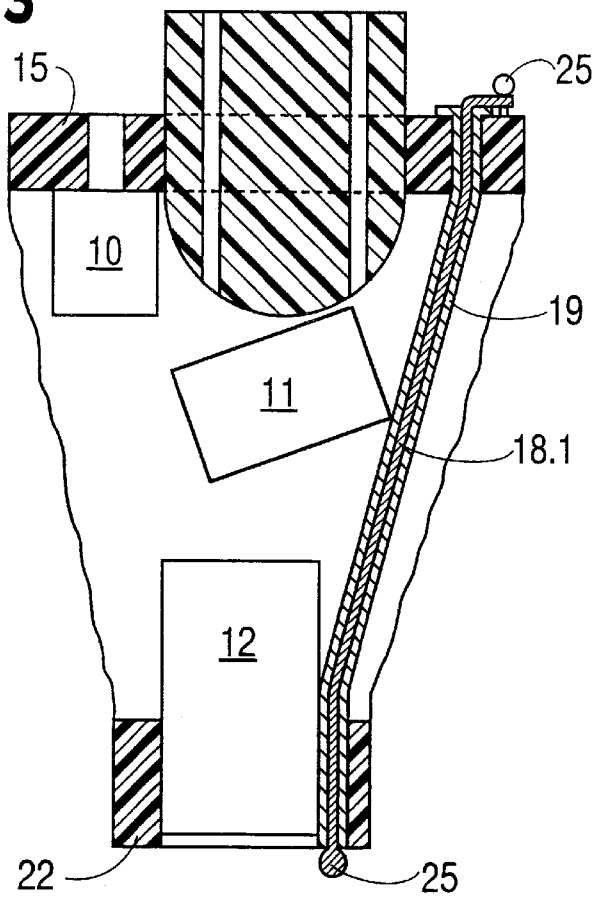

FIGS. 3 and 4 show embodiments of the inventive hearing aid in the general condition which hearing aids instead of a stiff provisional supporting element (18 of FIG. 1), comprise a flexible length-limiting element (18.1 in FIG. 3 and 18.2 ind FIG. 3), e.g. a string which is lengthwise not extendible.

The string 18.1 of the embodiment according to FIG. 3 runs in the same way as the provisional supporting element according to FIG. 1 through the face plate 15 and through the connecting means 22 and corresponding locking means 25 are provided. This length-limiting element is removed after casting of the body, whereby a ventilation channel is opened in the same way as when removing a provisional supporting element.

Around the length-limiting element 18.1, a tube 19 can be provided which tube is not removed from the hearing aid. This tube guarantees a minimum distance between the ventilation channel and the surface of the appliance and such prevents potential weak areas of the hearing aid. Such a tube may be provided also in connection with a stiff length-limiting element.

The length-limiting string 18.2 according to FIG. 4 is not positioned in a potential ventilation channel and remains in the individualized appliance. For the ventilation channel, a tube 19 is provided. For this embodiment, the tube 19 must be stable enough for keeping open under the influence of the casting pressure.

Figure 5:
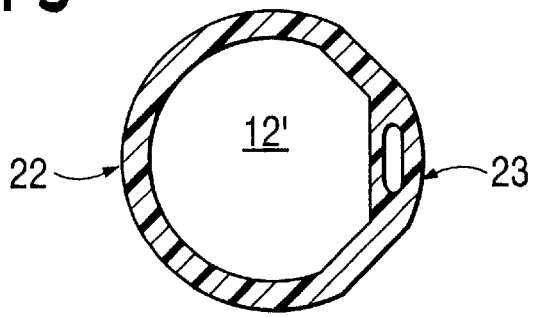
FIGS. 5 and 6 show two embodiments of connecting means for connecting loudspeaker and provisional supporting element.
Figure 6:
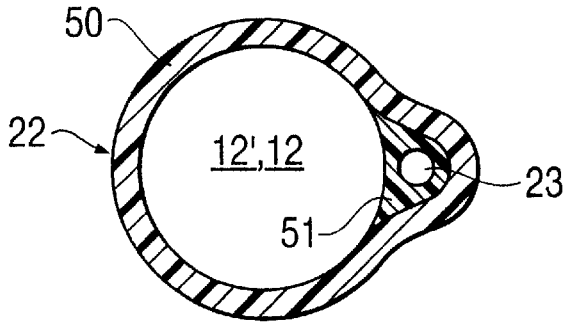

FIGS. 5 and 6 show two exemplified embodiments of connecting means 22 for an inventive hearing aid. Both connecting means serve as tight joints around the loudspeaker for preventing the casting material from leaking and they have an opening for the ventilation channel.

In FIG. 5 a gasket ring consisting of an elastic material is shown which can be employed as connecting means 22. It comprises a first opening 12' which is adapted to the form of the loudspeaker and a second opening 23 for the ventilation channel or the length-limiting element respectively. The area with the second opening 23 may protrude in tubular form towards the face plate or even through the face plate and surround the provisional supporting element over part of its length or over the whole of its length, similar to the tube 19 according to FIGS. 3 and 4.

Material and dimensioning of the connecting means 22 are to be matched such that the gasket is expanded when the loudspeaker is inserted such that the loudspeaker is held with elastic forces. The second opening 23 is to be dimensioned such that it is closed tightly by the provisional supporting element at least regarding the casting material and that it remains open even without supporting element (opening of the ventilation channel). If no ventilation channel is needed the opening can be dimensioned such that it closes on removing the provisional supporting element.

Connecting means 22 in FIG. 6 consist of an elastic gasket ring 50 and a sleeve 51 comprising an opening 23 and being advantageously fixed to the loudspeaker.

FIG. 7 shows in a section parallel to the axis of the (not completely shown) hearing aid and transverse to the sections of FIGS. 1 and 2, a casting template 32 inserted into the battery opening 16 of the face plate 15. It is evident from the Figure that the casting template comprises stops 55 in order to be able to be brought easily into a defined relative position to the face plate. Furthermore template 32 comprises lateral slots in which battery contacts 56 are positioned. When casting the body the ends of the contacts protruding through the slots are cast in and the free ends of the contacts are uncovered when the casting template is removed.

FIG. 8 shows a further exemplified embodiment of a face plate 15 which is again shown in section (same section as in FIG. 7). The battery rack of this embodiment is formed by a depression 60 in the face plate which depression has at least one pouring opening in its part nearest the bottom. For casting the body no casting template is required with this embodiment of the face plate. The battery contacts 56 are already positioned definitely in the walls of the depression.

Figure 9:
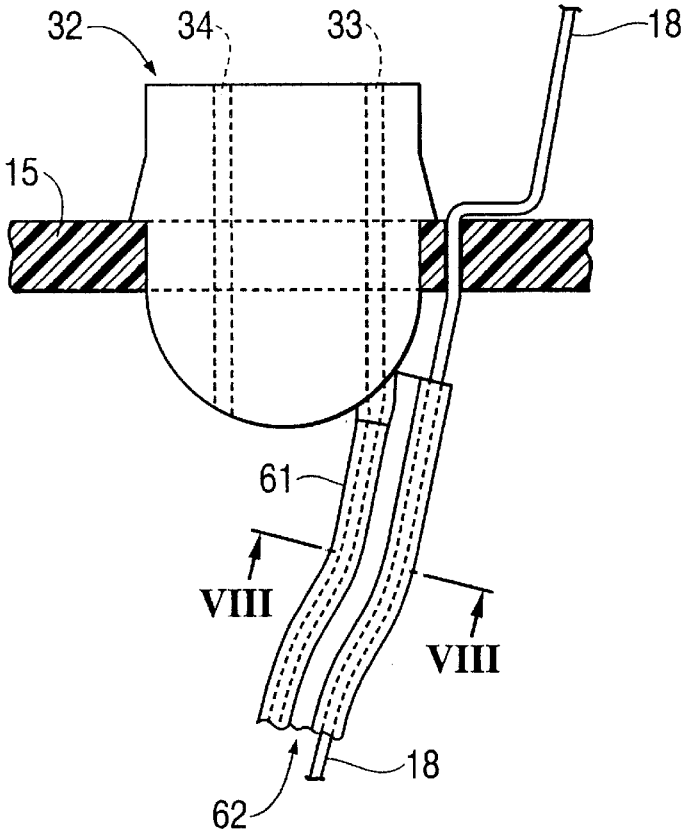
FIG. 9 shows a casting template with a pouring tube as a further detail of a further embodiment of the inventive hearing aid.

FIG. 9 shows in section a further exemplified embodiment of the inventive hearing aid of which hearing aid only the following parts are shown: part of the face plate 15, the casting template 32 with the pouring opening 33 and ventilation opening 34 positioned in the battery opening, part of the provisional supporting element 18 and a pouring tube 61. The pouring tube 61 is provided in order to make sure that the casting cavity of the general hearing aid is filled from the inside of the hearing aid towards its outside or towards the ventilation opening respectively. In such a manner, forming of cavities in the body can be prevented. This is especially important if a highly viscous casting material is used.

In order not to have to design the pouring tube as a stiff tube it is connected to the provisional supporting element 18 such that the two have a substantially parallel position. The connection between provisional supporting element 18 and pouring tube 61 is e.g. realized with a twin tube 62, whereby the one tube 61 serves as pouring tube and the supporting element 18 is stuck through the other tube. The two tubes of twin tube 62 are connected to each other with suitable means, e.g. they are formed in one piece.

Figure 10:
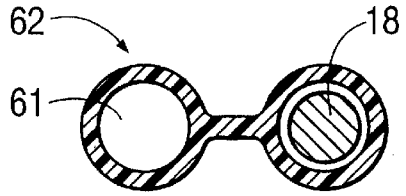
FIG. 10 shows a section through a provisional supporting element and pouring tube as a further detail of a further embodiment of the inventive hearing aid.

FIG. 10 shows a section through twin tube 62.

Figure 11:
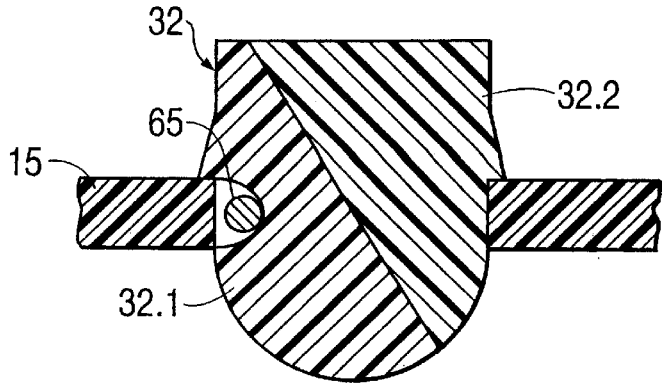
FIG. 11 shows a diagrammatic section through a further casting template positioned in the battery opening of the face plate of an inventive hearing aid and FIG. 12 shows a face plate with a battery rack, a pouring tube and a ventilation tube as details of a further exemplified embodiment of the inventive hearing aid in its general condition.

FIG. 11 shows in section (section plane as in FIGS. 1 and 2) a further embodiment of a casting template 32 which is positioned in the battery opening of a face plate. The casting template consists of two parts 32.1 and 32.2 and is especially suitable for the forming of a battery rack which is to form a recess behind the opening in the face plate. The shown battery opening has a hinge axis 65 which can, in a known manner, simultaneously operate as the axis of a slewable battery rack cover and as contact for programming the amplifier-chip. This hinge axis 65 creates a narrowing of the battery opening such that a casting template, as shown in FIGS. 1 and 9 is not positionable. The separating area between the two parts 32.1 and 32.2 of the template is advantageously oblique relative to the plane of the battery opening and can be designed e.g. with groove and tongue. It is also possible to design the separating area of the two parts such that a tubular cavity (e.g. formed by two corresponding grooves) is created between the two parts which cavity serves as ventilation opening.

Figure 12:
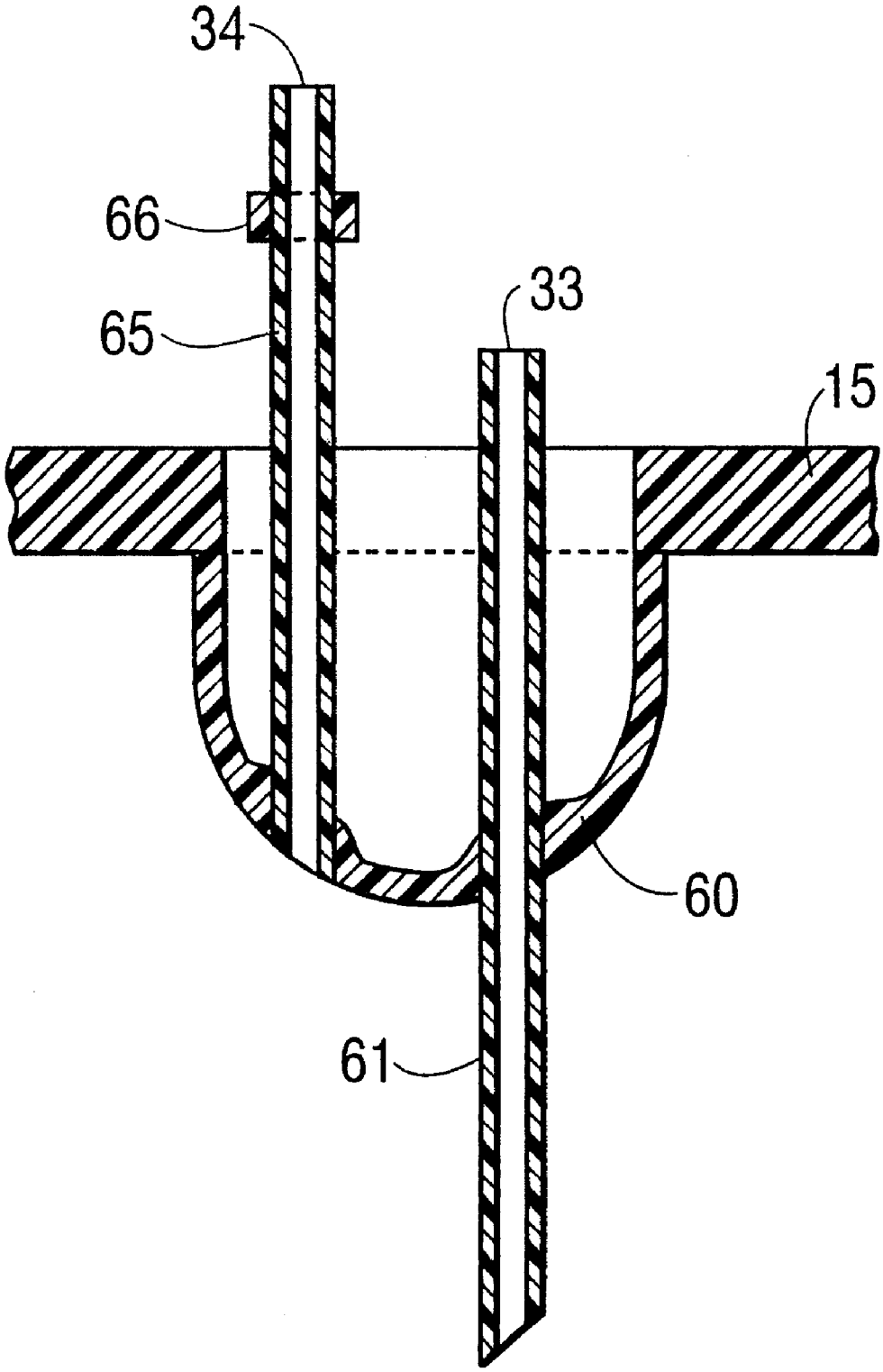

FIG. 12 shows the region of the face plate of a further exemplified embodiment of the inventive hearing aid. The face plate 15 comprises, as previously shown in connection with FIG. 7, a depression 60 designed as battery rack. The wall of the depression comprises two openings, whereby a pouring tube 61 with a pouring opening 33 is stuck through one of the openings which pouring tube 61 reaches far towards the inner face of the hearing aid and a ventilation tube 65 with a ventilation opening 34 advantageously consisting of a transparent plastic is stuck on the other opening. This ventilation tube 65 can be designed as monitoring instrument for supervision of the casting pressure. It is important that when casting the body for individualization of the inventive hearing aid a maximal casting pressure is not exceeded, in particular when carrying out the casting step in the auditory canal of a patient. As the casting materials to be used have a relatively high viscosity there is a high pressure drop in the tubes. It can be established experimentally how high the casting material rises in the ventilation tube 65 when an ideal casting pressure is reached. This height is marked with a mark 66 and casting material is poured until it reaches the mark 66.

We claim:

1. A hearing aid to be worn completely in the auditory canal of a patient, said auditory canal having a surface configuration, said hearing aid including components for enhancing auditory function, said hearing aid further comprising an outer face plate;

an inner face;

an elastic diaphragm surrounding said components for enhancing auditory function and defining a casting cavity around said components for enhancing auditory function and between said outer face plate and said inner face in a general state of said hearing aid, said diaphragm being fillable with a curable casting material so that an exterior surface of said diaphragm becomes a cured cast body having a shape closely matching said surface configuration of said auditory canal, thereby converting said general state of said hearing aid to an individualized state;

said hearing aid in said general state having a self-supporting, provisional supporting element extending between said outer face plate and said inner face and being removed from said cast body after curing of said cast body so that said cast body comprises the sole supporting element between said outer face and said inner face and for said components for enhancing auditory function; and said cured cast body comprises a resilient material.

2. A hearing aid according to claim 1 wherein said outer face plate includes an opening therethrough and said provisional supporting element extends through and protrudes from said outer face plate, said supporting element including means for locking said element in a desired position relative to said outer face plate.

3. A hearing aid according to claim 2 wherein said inner face includes connecting means having an opening therethrough and said provisional supporting element extends through said opening and protrudes beyond said inner face and including means for locking said supporting element in a desired position relative to said inner face.

4. A hearing aid according to claim 3 wherein said components for enhancing auditory function comprises a loudspeaker, said connecting means comprises an elastic gasket at an end of said membrane tightly surrounding said loudspeaker, and said provisional supporting element is tightly joined to said membrane adjacent said loudspeaker.

5. A hearing aid according to claim 4 wherein said connecting means comprises a tubular extension surrounding said provisional supporting element.

6. A hearing aid according to claim 5 wherein said provisional supporting element comprises a metal wire or tape.

7. A hearing aid according to claim 6 wherein said means for locking comprises a bent region of said metal wire or tape.

8. A hearing aid according to claim 7 wherein a part of said provisional supporting element extends across said inner face and including a tampon attached to said part of said provisional supporting element.

9. A hearing aid according to claim 1 wherein said outer face plate comprises a battery opening and said hearing aid comprises, in its general condition, a casting template (15) having a pouring opening therein, said casting template being in said battery opening for forming a battery rack in said cast body.

10. A hearing aid according to claim 9 wherein said casting template comprises slots for receiving contacts for said battery.

11. A hearing aid according to claim 10 wherein said casting template comprises two parts.

12. A hearing aid according to claim 1 wherein said outer face plate (15) comprises a depression for forming a battery rack in said body being cast, said depression having a pouring opening and wherein battery contacts are integrated into said depression.

13. A hearing aid according to claim 12 wherein said depression comprises a ventilation opening.

14. A hearing aid according to claim 13 wherein said ventilation opening comprises a transparent ventilation tube with a mark thereon for monitoring casting pressure.

15. A hearing aid according to claim 1 wherein said outer face plate comprises a battery opening and said hearing aid comprises, in its general condition, a casting template (15) having a pouring opening therein, said casting template being in said battery opening for forming a battery rack in said cast body, and a pouring tube connected to said pouring opening, said pouring tube being connected to said provisional supporting element and being held substantially parallel with said provisional supporting element.

16. A hearing aid according to claim 1 wherein said inner face includes connecting means having an opening therethrough and said provisional supporting element extends through said opening and protrudes beyond said inner face, and including a ventilation channel (43) extending through said cast body and opening at said outer face plate through an opening therein, and opening at said inner face through said opening in said connecting means.

17. A hearing aid according to claim 16 wherein said ventilation channel comprises a wall formed at least partly by said cast body.

18. A hearing aid according to claim 1 wherein said cast body has a Shore hardness A between 5 and 70.

19. A hearing aid according to claim 18 wherein said cast body consists of a two-component, addition-cross-linked silicon plastic.

20. A hearing aid to be worn completely in the auditory canal of a patient, said auditory canal having a surface configuration, said hearing aid including components for enhancing auditory function, said hearing aid further comprising an outer face plate;

an inner face;

an elastic diaphragm surrounding said components for enhancing auditory function and defining a casting cavity around said components for enhancing auditory function and between said outer face plate and said inner face in a general state of said hearing aid, said diaphragm being fillable with a curable casting material so that an exterior surface of said diaphragm becomes a cured cast body having a shape closely matching said surface configuration of said auditory canal, thereby converting said general state of said hearing aid to an individualized state;

said hearing aid in said general state having a flexible, non-self-supporting, length limiting element extending axially through said hearing aid so that said cast body comprises the sole supporting element between said outer face and said inner face and for said components for enhancing auditory function; and said cured cast body comprises a resilient material.

21. A hearing aid according to claim 20 wherein said outer face plate includes an opening therethrough and said length limiting element extends through and protrudes from said outer face plate, said length limiting element including means for locking said element in a desired position relative to said outer face plate.

22. A hearing aid according to claim 21 wherein said inner face includes connecting means having an opening therethrough and said length limiting element extends through said opening and protrudes beyond said inner face and including means for locking said length limiting element in a desired position relative to said inner face.

23. A hearing aid according to claim 22 wherein said components for enhancing auditory function comprises a loudspeaker, said connecting means comprises an elastic gasket at an end of said membrane tightly surrounding said loudspeaker, and said length limiting element is tightly joined to said membrane adjacent said loudspeaker.

24. A hearing aid according to claim 23 wherein said connecting means comprises a tubular extension surrounding said length limiting element.

25. A hearing aid according to claim 24 wherein said length limiting element comprises a string.

26. A hearing aid according to claim 25 wherein said means for locking comprises an enlarged region of said string.

27. A hearing aid according to claim 26 wherein a part of said length limiting element extends across said inner face and including a tampon attached to said part of said length limiting element.

28. A hearing aid according to claim 20 wherein said outer face plate comprises a battery opening and said hearing aid comprises, in its general condition, a casting template (15) having a pouring opening therein, said casting template being in said battery opening for forming a battery rack in said cast body.

29. A hearing aid according to claim 28 wherein said casting template comprises slots for receiving contacts for said battery.

30. A hearing aid according to claim 29 wherein said casting template comprises two parts.

31. A hearing aid according to claim 20 wherein said outer face plate (15) comprises a depression for forming a battery rack in said body being cast, said depression having a pouring opening and wherein battery contacts are integrated into said depression.

32. A hearing aid according to claim 31 wherein said depression comprises a ventilation opening.

33. A hearing aid according to claim 32 wherein said ventilation opening comprises a transparent ventilation tube with a mark thereon for monitoring casting pressure.

34. A hearing aid according to claim 20 wherein said inner face includes connecting means having an opening therethrough and said length limiting element extends through said opening and protrudes beyond said inner face, and including a ventilation channel (43) extending through said cast body and opening at said outer face plate through an opening therein, and opening at said inner face through said opening in said connecting means.

35. A hearing aid according to claim 34 wherein said ventilation channel comprises a wall formed at least partly by said cast body.

36. A hearing aid according to claim 20 wherein said cast body has a Shore hardness A between 5 and 70.

37. A hearing aid according to claim 36 wherein said cast body consists of a two-component, addition-cross-linked silicon plastic.

* * * * *